United States Patent [19]

Seles

[11] Patent Number: 4,719,733

[45] Date of Patent: Jan. 19, 1988

[54] METHOD AND APPARATUS FOR FINISHING A CORNER JOINT

[76] Inventor: Boleslaw Seles, 5153 S. Meade, Chicago, Ill. 60638

[21] Appl. No.: 918,159

[22] Filed: Oct. 14, 1986

Related U.S. Application Data

[63] Continuation of Ser. No. 818,043, Jan. 13, 1986, abandoned.

[51] Int. Cl.[4] ..... E04B 1/00

[52] U.S. Cl. ..... 52/288; 52/35; 52/741

[58] Field of Search ..... 52/288, 717, 741, 35, 52/387

[56] References Cited

U.S. PATENT DOCUMENTS

| | | | |
|---|---|---|---|
| 2,090,588 | 8/1937 | Witsell | 52/35 |
| 2,274,317 | 2/1942 | Bonnell | 52/287 |
| 3,222,837 | 12/1965 | Daley | 52/288 |
| 3,338,012 | 8/1967 | Kappenhagen et al. | 52/288 X |
| 3,950,907 | 4/1976 | Dahowski | 52/287 |
| 3,996,705 | 12/1976 | Gutierrez | 52/35 X |
| 4,315,390 | 2/1982 | Schaafsma | 52/288 |
| 4,520,605 | 6/1985 | Budd | 52/288 X |
| 4,601,149 | 7/1986 | Dokan | 52/287 |

OTHER PUBLICATIONS

"New Weldwood Moldings", (brochure), *Architectural Record*, p. 229, Sep. 1948.

*Primary Examiner*—Carl D. Friedman

*Attorney, Agent, or Firm*—Edmond T. Patnaude

[57] ABSTRACT

A method for providing a finished joint at a corner formed between two surface members, wherein the corner includes a substantially straight portion in continuity with a curvilinear portion, comprises the steps of providing an elongate molding, applying a bonding agent to the back surface of the molding and inserting the molding into the straight portion of the corner. A gauge is provided having a contoured edge which is similar in shape to the cross-sectional shape of the face surface of the molding. A bead of caulk is applied to the curvilinear portion of the corner and is manually shaped with the gauge such that the bead of caulking and the face surface of the molding form a substantially continuous joint around the corner between the two surface members. The molding comprises an elongate strip having a face side and a back side with a rib extending from the back side. A pair of stabilizing members extend from opposite sides of the distal end of the rib. The rib and stabilizing members are dimensioned such that the plane defined by the strip edge and stabilizing member edge on one side of the rib is substantially perpendicular to the plane defined by the strip edge and stabilizing member edge on the other side of the rib. The molding is thereby insertable into a right angle corner such that the face of the molding is disposed uniformly at forty-five degrees to the two surface members despite irregularities in the joint formed between the two members.

8 Claims, 4 Drawing Figures

METHOD AND APPARATUS FOR FINISHING A CORNER JOINT

This is a continuation of application Ser. No. 818,043, filed Jan. 13, 1986, now abandoned.

BACKGROUND OF THE INVENTION

1. Field of the Invention

The present invention relates generally to a method and apparatus for finishing a joint formed between two surface members, and more particularly, relates to providing a sealed corner joint in a bathtub or shower enclosure.

2. Description of the Prior Art

In the installation of a bathtub or shower unit, the unit is typically enclosed within a structural framework having wall members which are finished with a waterproof surface In order to provide for a completely waterproof enclosure, it is common practice to apply a bead of caulk in the corner formed between the wall surface and bathtub or shower unit. Water is thereby prevented from leaking through the corner joint and damaging the wall structure forming the enclosure. A desirable caulk material for waterproofing the corner joints in bathtub and shower enclosures is one which is room temperature vulcanized, such as a silicone rubber elastomer, for example. Such a caulk is available in tube form and is readily applied either directly from the tube or by the use of a suitable caulking gun. In either case, the tip of the tube is usually cut at an angle to permit the caulk to flow into the corner joint and be leveled or smoothed out by the tip as it is drawn along the corner The foregoing method of applying caulk requires a considerable degree of skill in achieving a proper seal between the wall surface and bathtub or shower unit while, at the same time, spreading the caulk evenly to produce an acceptable finished appearance. Without the exercise of skill in applying the caulk, an irregular or rippled surface finish often results which is unsightly in appearance and is difficult to clean. Moreover, repeated cleaning of the caulk to eliminate mildew formation, for example, particularly with the use of chemical cleaning agents and harsh scrubbing means can substantially reduce the life of the caulk thereby resulting in premature failure of the seal between the wall surface and bathtub or shower unit.

SUMMARY OF THE INVENTION

Accordingly, an object of the invention is to provide a new and improved method and apparatus for sealing the corner formed between a wall surface and a bathtub or shower unit Another object of the invention is to provide such an improved method and apparatus having the capability of achieving a finished corner joint which is uniform in appearance and lends itself readily to cleaning Still a further object of the invention is to provide such an improved method and apparatus having the capability of achieving an effective corner seal with ease of installation.

In accomplishing these and other objectives of the present invention, the invention is directed in one aspect to a method for providing a joint at a corner formed between two surface members wherein said corner includes a substantially straight portion in continuity with a curvilinear portion, and comprises the steps of providing a generally elongate molding for insertion into the straight portion of the corner, with the molding having a face surface and a back surface extending longitudinally thereof and including a rib projecting from the back surface. A bonding agent is applied to the back surface of the molding and the molding is inserted into the straight portion of the corner with the bonding agent in contact with at least one of the two surfaces. A shaping gauge is provided having a contoured edge which is similar in shape to the cross-sectional shape of the face surface of the molding. A bead of caulk is applied to the curvilinear portion of the corner and the caulk bead is shaped with the contoured edge of the gauge such that the caulk and the face surface of the molding are substantially continuous at the juncture between them.

In another aspect of the invention, there is provided a molding for finishing a corner joint formed between two generally perpendicular surface members, wherein the molding comprises a generally elongate surface strip having a face side and a back side together defining a pair of generally parallel edges extending longitudinally of the strip. A rib, extending the length of the strip and projecting from the back surface thereof, is oriented centrally of the back surface at substantially right angles to the plane defined by the edges of the strip. A pair of stabilizing members project respectively, from opposite sides of the rib at its distal end, and each of the stabilizing members has an end portion defining an edge. The rib and stabilizing members are dimensioned such that the plane defined by the strip edge and stabilizing member edge on one side of the rib is substantially perpendicular to the plane defined by the strip edge and stabilizing member edge on the other side of the rib. The molding may thereby be bonded into a corner to provide a uniform, finished transition member between the two surface members regardless of irregularities in the relative spacing of the surface members where they meet to form the corner. At the same time, the bonding agent may act as a sealant to waterproof the joint formed by the two surface members

DESCRIPTION OF THE DRAWINGS

Further objects and advantages and a better understanding of the present invention will be had by reference to the following detailed description taken in connection with the accompanying drawings wherein.

Figure 1:
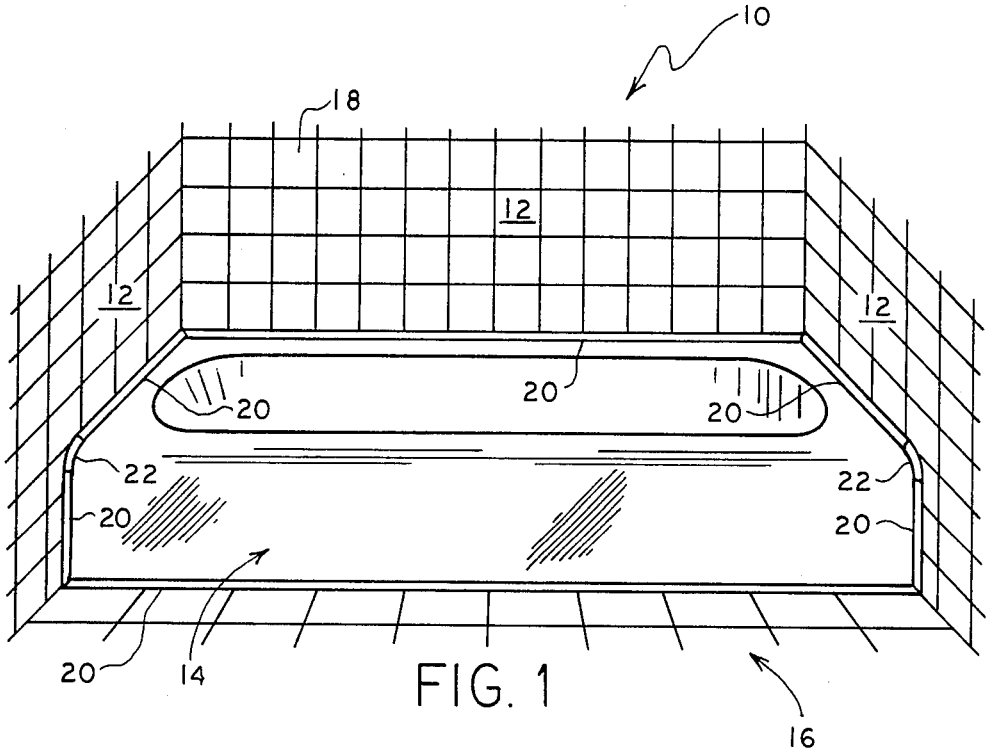
FIG. 1 is a perspective view of a bathtub enclosure illustrating use of a molding in accordance with the present

Referring now to the drawings and more particularly to FIG. 1 thereof, there is shown a bathtub enclosure, designated generally by the reference numeral 10, including a plurality of wall surfaces 12, 12 constructed to surround and enclose a bathtub 14. In a well-known manner, the bathtub 14 is installed within the enclosure 10 such that it rests on a floor covered with vinyl tile 16, or the like. The wall surfaces 12, 12 may also be covered with a suitable ceramic tile 18. As will be described in greater detail hereinafter, at the corners formed between the bathtub 14 and the surrounding wall and floor surfaces are a plurality of generally straight molding sections 20 interconnected at the curvilinear portions of the bathtub 14 with shaped caulk beads 22, 22.

Figure 2:
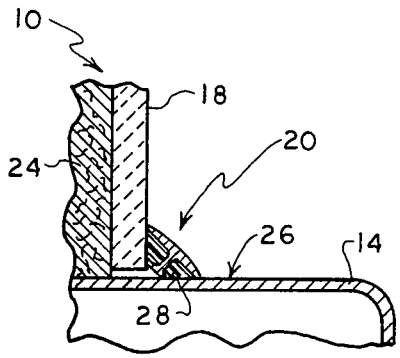
FIG. 2 is a typical cross-sectional view of the bathtub enclosure illustrated in FIG. 1.

Turning now to FIG. 2, the construction of the bathtub enclosure 10 is shown in cross-section and can be seen to include a drywall sheet 24 which is installed in abutment with upper surface 26 of the bathtub 14. Ceramic tile 18 is applied to the drywall sheet 24 forming a right angle corner where it meets the upper surface 26 of the bathtub 14. Inserted at the corner formed by the ceramic tile 18 and the bathtub 14 is a molding 20 which is secured within the corner by a suitable bonding agent 28.

Figure 3:
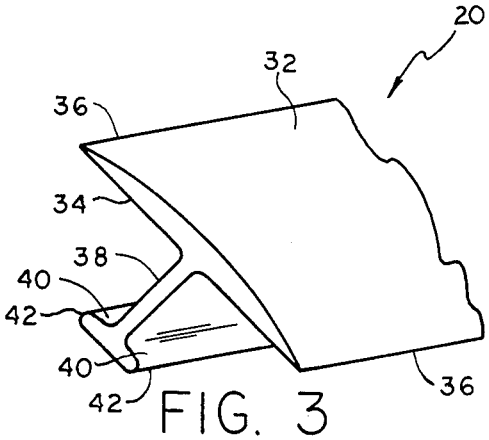
FIG. 3 is a cross-sectional view of a molding in accordance with the present invention.

The details of the molding 20 can best be seen in FIG. 3 as including a generally elongate surface strip 30 having a face side 32 and a back side 34 which together converge to define a pair of edges 36 extending longitudinally of the strip 30. Positioned centrally of the surface strip 30 and projecting from the back side 34 thereof, is a rib 38. Preferably, the back side 34 of the surface strip 30 is planar in configuration and the rib 38 is oriented at substantially right angles thereto. At its distal end, the rib 38 is provided with a pair of laterally extending wing members 40, 40 each of which terminates in an edge 42 extending the length of the molding 20. In accordance with the invention, the wing members 40 and rib 38 are so dimensioned that the plane defined by the wing edge 42 and surface strip edge 36 on one side of the rib 38 is perpendicular to the plane defined by the wing edge 42 and surface strip edge 36 on the other side of the rib 38. Thus, as best seen in FIG. 2, the wing members 40, 40 act as stabilizing means for uniformly maintaining the surface strip 30 of the molding 20 at approximately a 45 degree interior angle to both the wall surface 12 and the bathtub 14, the entire length of the molding 20, regardless of irregularities in the spacing of the wall surface finish 18 with respect to the bathtub 14.

Figure 4:
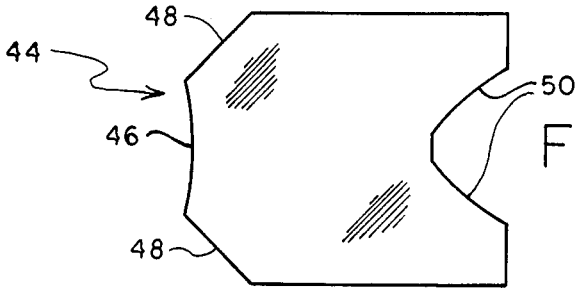
FIG. 4 is a plan view of a gauge member in accordance with the present invention.

To convey the appearance of a straight and uniform corner joint with the molding 20 installed, preferably the molding 20 is fabricated of a relatively rigid and durable material such as vinyl, for example, and is manufactured by a continuous extrusion process whereby the extrusion may be cut into straight sections in length suitable for its convenient packaging and installation. Since a typical bathtub or shower unit has curvilinear surfaces which form irregularly shaped corners where the unit meets the walls of the surrounding enclosure, the molding 20, if fabricated of a relatively rigid material, is not capable of being conveniently shaped to conform to a curvilinear portion of the corner formed between the unit 14 and adjacent wall surfaces 12, 12. Therefore, in accordance with the invention and as best seen in FIG. 1, sections of the molding 20 are cut to appropriate lengths and inserted into the straight portions of the corners, and the curvilinear corner portions situated between adjacent straight sections of the molding 20 are filled with a bead of suitable caulk 22. The caulk beads may be formed from silicone rubber elastomer, which is also suitable for use as the bonding agent 28 for securing the molding 20 in place In order to effect a smooth transition between straight sections of molding 20 which meet at a curvilinear corner, with reference now to FIG. 4, a gauge 44 is provided for shaping the surface of the caulk bead 22. The gauge 44 is preferably stamped from a thin sheet of material such as vinyl so that it will not unduly adhere to the caulk material 22. The gauge 44 is symmetrical about a horizontal axis as viewed in FIG. 4, and is provided with a finishing edge 46 having a shape which is identical to the cross-sectional shape of the face side 32 of the molding 20. Extending away from the finishing edge 46 are guide edges 48, 48 which are arranged with respect to each other such that they form a 90 degree included angle. In use, the gauge 44 may be placed over the bead of caulk 22 such that one guide edge 48 is in contact with the wall surface 12 while the other edge 48 is in contact with the adjacent surface 26 of the bathtub or shower unit 14. The gauge 44 is then drawn along the curvilinear portion of the corner such that the finishing edge 46 removes excess caulk and shapes the caulk bead 22 such that it has the same surface contour as the surface contour of the face side 32 of the molding 20. The caulk bead 22 can thereby be shaped to provide a smooth transition at its juncture with a straight section of molding 20.

The end of the gauge 44 opposite the finishing edge 46 may also be provided with a recessed edge 50 having dimensions such that the gauge can receive the rib 38 and the wing members 40 of the molding 20. If desired, the molding bonding agent 28 may be applied liberally to the back side 34 of the molding 20 and the recessed edge 50 of the gauge 44 may then be manually drawn along the rib 38 and wing members 40 of the molding to level the surface of the bonding agent 28 and effect a uniform application of the bonding agent 28 running the length of the molding 20. The recessed edge 50 may be formed with a curvature such that a slight excess of bonding agent 28 is applied to the molding 20 and better sealing of the corner may be obtained It can be appreciated that the present invention provides not only a convenient but highly effective method and apparatus for the sealing of corners formed between surface members such as those found in bathtub or shower enclosures. With sufficient bonding agent 28 applied to the back side 34 of the molding 20, as heretofore described, the joint formed between the wall surface 12 and bathtub or shower unit 14 can easily be filled and waterproofed by the bonding agent 28 and the bonding agent may simultaneously serve to secure the molding 20 in place over the joint. In one method of installing the molding 20 the bonding agent 28 is applied directly to the back surface 34 of the molding 20. However, if desired, a bead of bonding agent 28 may first be applied to the corner intended to be sealed, and then the molding 20 may simply be inserted into the corner such that the rib 28 imbeds in and spreads the bonding agent 28. The face side 32 of the molding 20 may have virtually any cross-sectional shape, but is preferably smooth as to be easily cleaned and less susceptible to mildew formation. Thus, the invention completely overcomes the difficulties associated with achieving a uniform corner joint by conventional caulking methods While the present invention has been described in connection with particular embodiments thereof, it will be understood by those skilled in the art that many changes may by made without departing from the true spirit and scope of the present invention. Therefore, it is intended by the appended claims to cover all such changes and modifications which come within the true spirit and scope of this invention.

What is claimed as new and desired to be secured under Letters Patent of the United States is:

1. A finished joint at an inside corner formed between two generally planar surface members which are in substantial perpendicular relationship relative to one another, comprising in combination an elongate one-piece molding member having a surface strip portion having a face side, a back side, and a rib projecting into said inside corner from said back side, the distal end portion of said rib having first and second mutually parallel elongate edges, said face side of said molding member having third and fourth elongate edges extending parallel to said first and second edges, said first elongate edge and said third elongate edge defining a first plane, said second elongate edge and said fourth elongate edge defining a second plane, said first and second planes being mutually perpendicular, said molding member being positioned in said corner with said third and fourth edges respectively abutting said surface members and at least one of said first and second edges abutting one of said surface members, said surface members, said rib and said back side of said strip portion defining first and second cavities, and said cavities being substantially filled with a bonding agent.

2. A finished joint according to claim 1 comprising a pair of wing portions extending from said rib at the distal end portion thereof, and said first and second edges being disposed on said wing portions.

3. A method for providing a finished joint at a corner formed between two surface members wherein said corner includes a substantially straight portion in continuity with a curvilinear portion comprising the steps of:

providing a generally elongate molding for insertion into the straight portion of said corner, said molding having a face surface and a back surface extending longitudinally thereof and including a rib projecting from said back surface;

applying a bonding agent to the back surface of said molding;

inserting said molding into the straight portion of said corner with said bonding agent in contact with at least one of the said surfaces;

providing a shaping gauge having a contoured edge which is similar in shape to the cross-sectional shape of the face surface of the molding;

applying a bead of caulk to the curvilinear portion of said corner; and shaping said bead of caulk with the contoured edge of said gauge such that the caulk and the face surface of the molding are substantially continuous at the juncture therebetween.

4. The method of claim 3 wherein said bonding agent is the same material as said caulk.

5. The method of claim 3 wherein said bonding agent is applied to said molding back surface on two sides of said rib.

6. The method of claim 3 wherein said rib is inserted into said corner into contact with at least one of said surface members.

7. The method of claim 3 wherein said bonding agent provides a seal between the two surface members.

8. The method of claim 3 further including the steps of:

providing a shaping gauge having a second contoured edge for receiving the rib of the molding; and shaping the bonding agent with said second edge after said bonding agent is applied to the molding to form a bonding agent layer which is substantially uniform in thickness the length of said molding.

* * * * *